United States Patent [19]

Eckersley

[11] 4,371,435

[45] Feb. 1, 1983

[54] PLACER MINING SLUICE

[76] Inventor: Colin Eckersley, 2185 Qualicum Dr., Vancouver, B.C., Canada, V5P 2M3

[21] Appl. No.: 313,804

[22] Filed: Oct. 22, 1981

[51] Int. Cl.[3] ..... B03B 5/26; B03B 7/00

[52] U.S. Cl. ..... 209/44; 209/257; 209/281; 209/458; 209/508

[58] Field of Search ..... 209/44, 254, 281, 274, 209/353, 257, 255, 458, 508

[56] References Cited

U.S. PATENT DOCUMENTS

| | | | |
|---|---|---|---|
| 146,275 | 1/1874 | Paul | 209/353 X |
| 234,826 | 11/1880 | Waugaman | 209/44 X |
| 786,322 | 4/1905 | Stein | 209/44 |
| 790,572 | 5/1905 | Hickman | 209/355 |
| 801,968 | 10/1905 | Clark | 209/44 |
| 883,861 | 4/1908 | Creasy | 209/44 |
| 1,510,742 | 10/1924 | Gutleben | 209/420 |
| 1,588,102 | 6/1926 | Goody | 209/458 X |
| 1,915,602 | 6/1933 | Goody | 209/44 X |
| 1,973,770 | 9/1934 | McCullough | 209/44 X |

FOREIGN PATENT DOCUMENTS

| | | | |
|---|---|---|---|
| 185036 | 5/1907 | Fed. Rep. of Germany | 209/458 |
| 2901 | of 1863 | United Kingdom | 209/44 |

*Primary Examiner*—Ralph J. Hill
*Attorney, Agent, or Firm*—Richard H. Zaitlen

[57] ABSTRACT

A placer mining sluice for separating relatively heavy particulate valuable materials from relatively light waste material. The mining sluice includes an inverted generally V-shaped grizzly screen having first and second sides which slope downwardly and outwardly from a longitudinal axis of the screen. First and second panels are positioned at opposed ends of the screen to close off the ends of the screen. A deflector pan having opposed first and second ends is positioned beneath the grizzly screen to extend between the first and second screen sides and between the first and second screen ends. The first end of the pan contacts the first panel. A tray is positioned beneath the deflector pan and screen at an angle relative to the horizontal with the uppermost tray end beneath the second end of the deflector pan. Material passing through the screen passes over the deflector pan second end onto the uppermost end of the tray.

11 Claims, 12 Drawing Figures

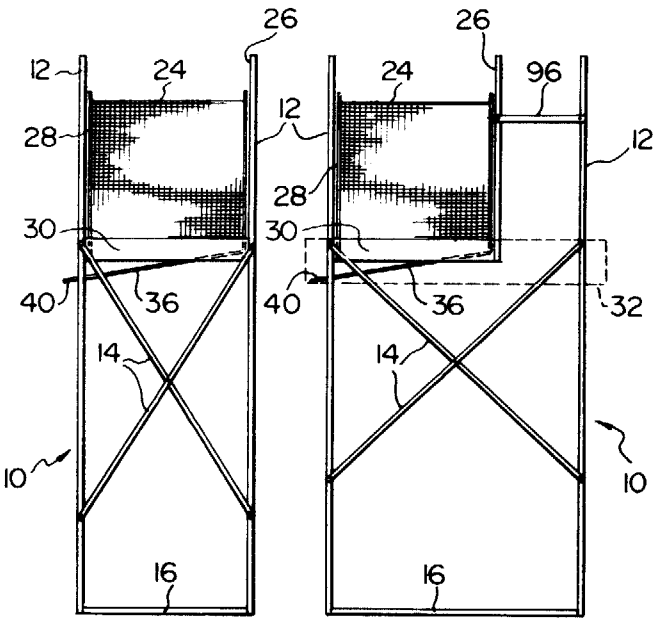
FIG. 3
FIG. 2
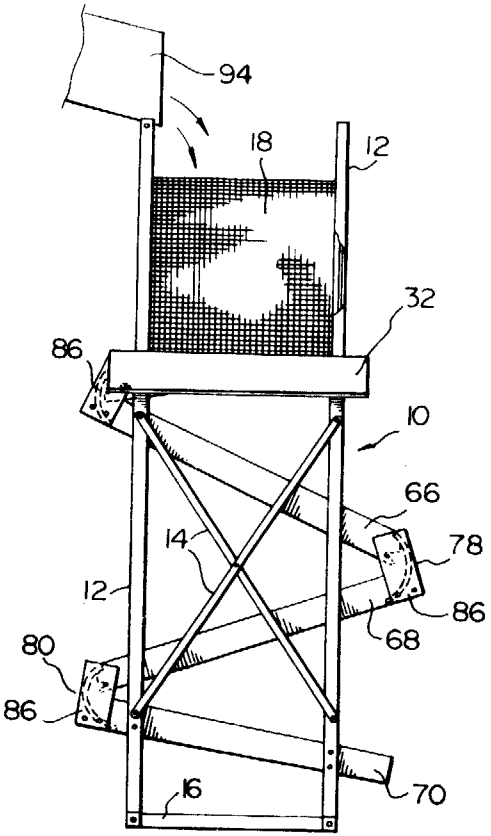
FIG. 1

PLACER MINING SLUICE

FIELD OF THE INVENTION

This invention relates to mining sluices, particularly placer mining sluices which separate relatively heavy particulate valuable materials from a mixture of relatively lighter waste materials and water.

BACKGROUND OF THE INVENTION

Placer mining sluices are conventionally used to separate relatively heavy particulate valuable materials such as gold dust, gold nuggets, silver, platinum, mercury or mercury-coated gold from relatively lighter waste materials. The mining operation is usually conducted near a stream or other source of flowing water. Raw material such as sand, gravel, mud or a mixture thereof which is believed to contain particulate valuable material is extracted from the stream bed (or other raw material source such as a pile of tailings accumulated from hard rock mining) and dumped into the mining sluice. Some water is diverted from the flowing stream (or a separate source of flowing water is provided) and caused to flow through the mining sluice, carrying with it the raw material from which particulate valuable material is to be separated. A grizzly screen is typically provided to prevent bulky material (rocks or other objects having a diameter in excess of about ¼ inch) from entering the mining sluice. After passing through the grizzly screen, the water/raw material mixture flows over one or more inclined trays. Matting and screening placed upon the tray surface(s) traps relatively heavy particulate valuable materials. Periodically, the miner stops the flow of water and raw material through the mining sluice and extracts therefrom any valuable materials which may have accumulated on the tray surfaces.

One disadvantage of conventional mining sluices has been the loss from the sluice of a relatively large amount of raw material from which particulate valuable materials might possibly have been separated. For example, gaps in the mining sluice structure often permit raw material to escape from the mining sluice apparatus without passing over the tray surface(s). Accordingly, one object of the present invention is to provide a mining sluice which is designed to enable the operator to maximize retention of raw material within the mining sluice apparatus for passage over the tray surface(s).

A second disadvantage of conventional mining sluices has been their relatively cumbersome structure which makes it difficult or time consuming to transport the mining sluice to and from a mining site (which will typically be located in rugged country). Such cumbersome structures may also complicate the procedure required to set up the mining sluice and may also hinder adjustment of the mining sluice to suit the conditions at a particular mining site. For example, it may be that a miner will discover that conditions at a particular mining site indicate the presence of relatively fine particulate valuable material (say, for example, gold dust as opposed to gold nuggets). Retention of such fine particulate valuable material by the mining sluice dictates the positioning of the tray(s) at a relatively small angle with respect to the horizontal to maximize the rejection of bulkier waste material from the mining sluice while retaining finer particulate valuable material in the mining sluice. Conversely, if the miner discovers that conditions at a particular mining site indicate the presence of relatively heavier particulate valuable material (say, for example, gold nuggets as opposed to gold dust) then it would be desirable to decrease the angle of the tray(s) with respect to the horizontal to avoid washing the relatively heavier valuable material completely through the mining sluice. If multiple trays are provided, then it may even be desirable to provide (for example) a relatively large angle of inclination on the uppermost tray and progressively smaller angles of inclination on lower trays in order to separate a range of sizes of particulate valuable materials from the raw material. Because conditions at different mining sites may differ (indeed, conditions may vary over time at a given mining site) it is desirable to provide means whereby the mining sluice may be adjusted quickly and efficiently to enable the operator to maximize retention of particulate valuable materials. Accordingly, a second object of the invention is to provide a mining sluice which may quickly and effectively be adjusted to vary the inclination of the tray(s) relative to the horizontal.

Another disadvantage of conventional mining sluices has been the relatively rapid build-up around the base of the mining sluice of a substantial quantity of waste material which interferes with the operation of the mining sluice. Accordingly, a further object of the invention is to provide deflection means for deflecting waste material away from the base of the mining sluice, resulting in less frequent need to clear away waste material from the base of the mining sluice.

SUMMARY OF THE INVENTION

The invention is directed to a mining sluice comprising an inverted generally V-shaped screen having first and second sides which slope downwardly and outwardly from a longitudinal axis of the screen. First and second panels are provided for positioning at opposed ends of the screen axis to close the screen ends. A deflector pan having opposed first and second ends is provided for positioning beneath the screen to extend between the first and second screen sides and between the first and second screen ends with the first end of the pan in contact with the first panel. A first tray is provided for positioning beneath the deflector pan and screen at an angle relative to the horizontal and with its uppermost end beneath the second end of the pan whereby material passing through the screen may pass over the deflector pan second end onto the uppermost tray end.

Preferably, the deflector pan slopes downwardly from the first deflector pan end to the second deflector pan end.

Advantageously, the deflector pan further comprises first and second generally vertical sidewalls for extending between the first and the second deflector pan ends to contact the first and second screen sides respectively. The sidewalls and the first panel may form an integral unit. Advantageously, the panels may be sized to extend above the first and second screen ends.

Advantageously, first and second deflector fins are provided for positioning at the lowermost ends of the first and second screen sides to extend downwardly therefrom, whereby material placed upon the screen which does not pass through the screen may be deflected away from the mining sluice.

A first semi-cylindrical trough may be provided for overlapping the second deflector pan end and the uppermost tray end to guide material from the deflector pan onto the first tray.

The mining sluice may further comprise a second tray for positioning beneath the first tray at an angle relative to the horizontal and with the uppermost end of the second tray beneath the lowermost end of the first tray, whereby material may pass from the first tray onto the second tray.

Preferably, the lowermost end of the first tray is pivotally connected to the uppermost end of the second tray.

The mining sluice may further comprise support means for supporting the first and second trays. The support means may include adjustable connecting means for connecting the uppermost end of the first tray to the support means.

BRIEF DESCRIPTION OF THE DRAWINGS

FIG. 1 is a side elevation view of a first embodiment of the invention;

FIG. 2 is a simplified illustration of the first embodiment shown in FIG. 1;

FIG. 3 is a simplified side elevation view of a second embodiment of the invention;

DESCRIPTION OF THE PREFERRED EMBODIMENT

Figure 4:
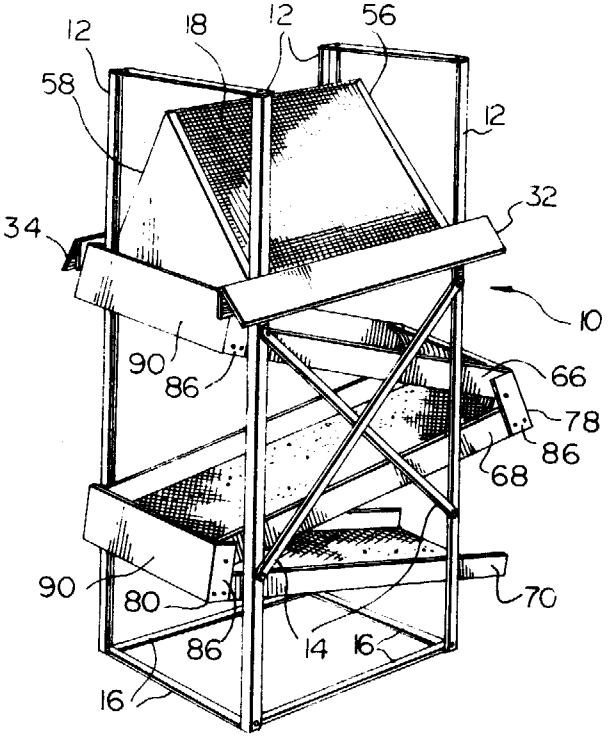
FIG. 4 is a pictorial representation of a third embodiment of the invention.
Figure 9:
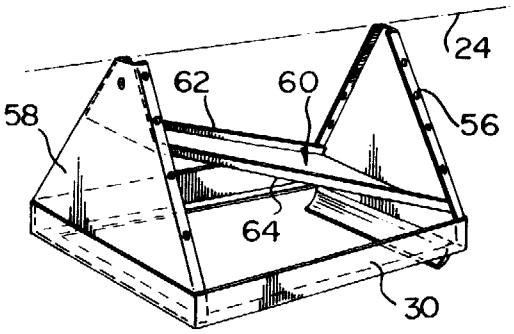
FIG. 9 is a pictorial representation showing the assembly of the deflector pan and end panels of FIGS. 7 and 8 and showing a grizzly support frame, which frame is used in all three embodiments.

The invention will be described with reference to three separate embodiments. The first embodiment, shown in FIGS. 1 and 2, provides a relatively compact mining sluice which may be used to "test" a mining site for the possible presence of valuable particulate materials. The second embodiment, shown in FIG. 3 is an expanded version of the first embodiment which enables the use of relatively long sluice trays as compared with those used in the first embodiment. The third embodiment, shown in FIG. 4, is identical to the second embodiment, except for the grizzly screen and deflector pan which, for the third embodiment, are shown in FIGS. 6 through 9.

FIGS. 1 through 4 depict a mining sluice which is generally designated 10. Vertical leg support members 12 at the four corners of mining sluice 10 are held in position by cross braces 14 and base supports 16. The two base supports 16 along the sides of the apparatus may be of different lengths depending upon which of the three embodiments is used. Advantageously, a plurality of spaced apart holes are provided in each of leg support members 12 and bolts and wing nuts are used to connect leg supports 12 to cross braces 14 and brace supports 16 so that mining sluice 10 may be readily assembled, disassembled or adjusted as hereinafter described.

Figure 6:
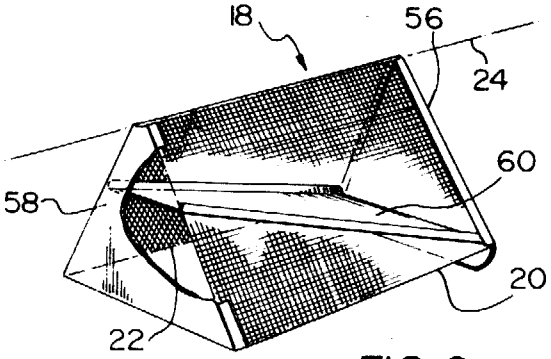
FIG. 6 is a fragmented pictorial representation of a grizzly screen, deflector pan and end panels for use with the third embodiment of the invention.

An inverted generally V-shaped screen or "grizzly" 18 is positioned in the upper portion of mining sluice 10 to extend between leg support members 12. Grizzly 18 has a first side 20 and a second side 22 (best seen in FIG. 6) each of which sides slope downwardly and outwardly from longitudinal axis 24 of grizzly 18. Grizzly 18 may be formed by bending a rectangular piece of metal screening into an inverted generally V-shaped configuration as shown in FIG. 6 to leave opposed ends of grizzly 18 open. The holes in grizzly 18 should be small enough to prevent objects having a diameter in excess of about ¼ inch passing through the screen.

Grizzly and Deflector Pan for First or Second Embodiment

In the first or second embodiment, first and second removable panels 26 and 28 are positioned at opposed ends of grizzly 18 to close those ends, preventing the loss of material which has passed through grizzly 18. Panels 26 and 28 are sized so that they may be slidably inserted between the ends of grizzly 18 and leg support members 12. Grizzly 18 is supported in a rectangular frame 30 (FIG. 9) which is affixed to leg support members 12 to prevent panels 26 and 28 sliding too low with respect to grizzly 18. Panels 26 and 28 are preferably made somewhat larger than the open ends of grizzly 18 so that the panels will project above the ends of grizzly 18 and tend to reflect back onto grizzly 18 material which might bounce off grizzly sides 20 and 22 and otherwise escape over the ends of grizzly 18.

Deflector fins 32 and 34 extend along the lowermost edges of grizzly sides 20 and 22 and project downwardly therefrom such that material which passes over grizzly sides 20 and 22 is deflected by deflector fins 32 or 34 away from the base of mining sluice 10.

Figure 5:
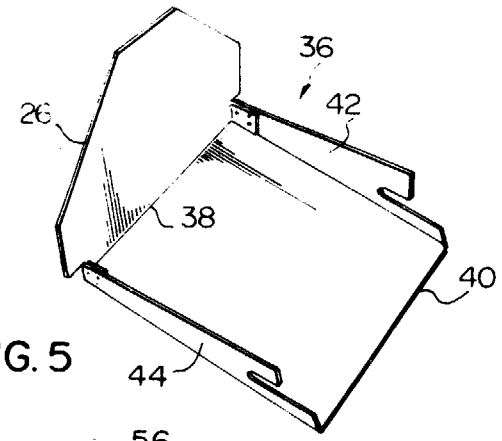
FIG. 5 is a pictorial representation of a deflector pan for use with the first or second embodiment of the invention.
Figure 10:
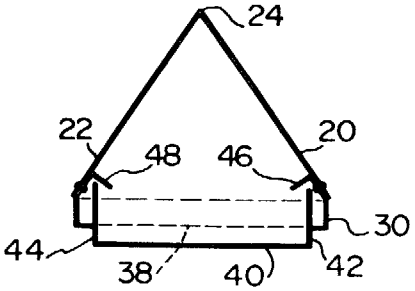
FIG. 10 is an end view of the grizzly and deflector pan used with the first or second embodiment of the invention.
Figure 7:
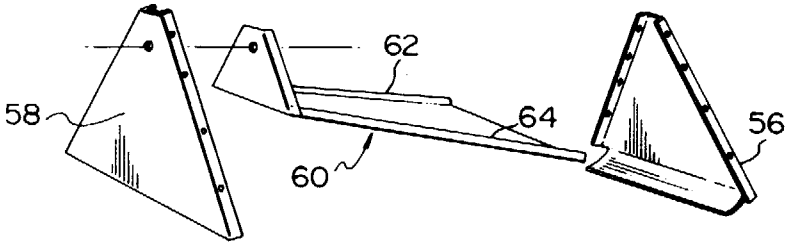
FIG. 7 is an exploded pictorial representation of the deflector pan and end panels of FIG. 6.
Figure 8:
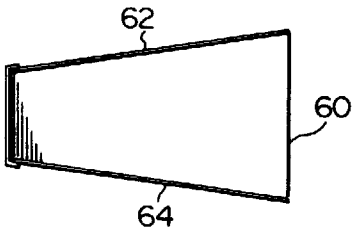
FIG. 8 is a top plan view of the deflector pan of FIG. 7.

A deflector pan 36 (FIG. 5) having a first end 38 and an opposed second end 40 is positioned beneath grizzly 18 to extend between sides 20 and 22 and between panels 26 and 28. First deflector pan end 38 contacts panel 26. As shown in FIG. 5, deflector pan 36 slopes downwardly from first end 38 toward second end 40. Deflector pan 36 includes first and second generally vertical sidewalls 42 and 44 which extend between deflector pan ends 38 and 40 directly beneath the undersides of grizzly 18 as shown in FIG. 10.

Inner deflectors 46 and 48 (FIG. 10) are affixed along the inside lower edges of grizzly sides 20 and 22 to deflect material toward the center of deflector pan 36. Deflector pan sidewalls 42 and 44 are provided to deflect and distribute uniformly across the surface of deflector pan 36 material which might otherwise tend to flow off deflector pan 36 after passing through grizzly 18. Preferably, deflector pan 36, sidewalls 42 and 44 and first panel 26 form an integral unit as shown in FIG. 5.

Grizzly and Deflector Pan for the Third Embodiment

FIGS. 6 through 9 shown a combined grizzly and deflector pan for the third embodiment which is shown in FIG. 4. It is contemplated that this combined grizzly and deflector pan may be used in place of the grizzly and deflector pan described above with reference to the first and second embodiments by those who may wish to minimize the number of individual pieces included in the overall apparatus.

As shown in FIGS. 6 through 9, the combined grizzly and deflector pan of the third embodiment includes a grizzly screen 18 which may be substantially identical to that provided in the first or second embodiments. Sheet metal end panels 56 and 58 are riveted onto opposed ends of grizzly screen 18 to close those ends. Deflector pan 60 is riveted to the underside of grizzly 18 to slope from end panel 58 to end panel 56. The edges 62 and 64 of deflector pan 60 are folded up to protrude above the surface of deflector pan 60 and serve both as flanges for riveting deflector pan 60 to grizzly 18 and as retainers to prevent loss of material over the deflector pan edges. As may be seen in FIGS. 6, 7 and 9, the lower edge of end cover 56 protrudes below and scoops under the lower end of deflector pan 60 so that material flowing off the lower end of deflector pan 60 is guided onto the trays described hereinafter.

Sluice Trays

Figure 11B:
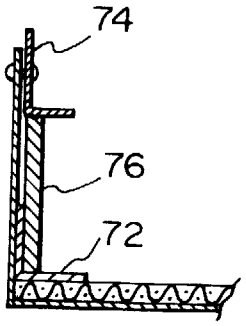
FIG. 11B is a cross-sectional view with respect to line B—B of FIG. 11A.
Figure 11A:
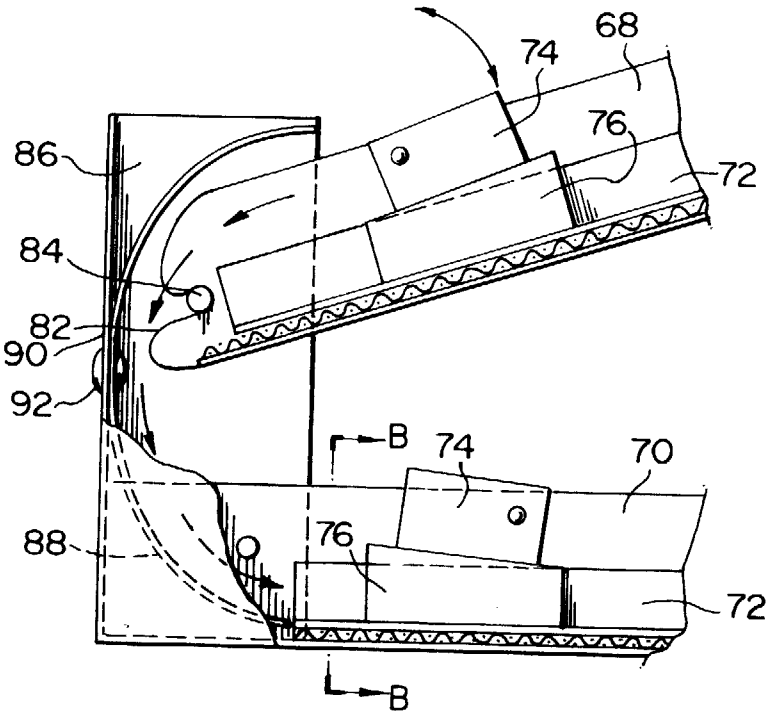
FIG. 11A is a fragmented side view showing material being guided from an upper tray onto a lower tray.

A first tray 66 (FIGS. 1 and 4) is positioned beneath grizzly 18 and deflector pan 36 (or, if the third embodiment is used, beneath grizzly 18 and deflector pan 60) at an angle relative to the horizontal. The uppermost end of tray 66 lies beneath second end 40 of deflector pan 60. The surface of first tray 66 is covered with a piece of relatively thick pile carpet or "rugging" and an expanded metal screen is placed on top of the rugging. Means are provided to hold the screen and rugging in place and to prevent their sliding relative to the surface of first tray 66. Preferably, as shown in FIGS. 11A and 11B, removable "L" shaped members 72 extend along the inside corners of each tray on top of the screening and rugging. Brackets 74 are pivotally mounted along the inside edges of the trays above "L" shaped members 72. Removable wedges 76 are firmly wedged between members 72 and brackets 74 to hold the screening and rugging firmly in place upon the tray surfaces. Wedges 76 and members 72 may easily be removed to facilitate cleaning or replacement of the rugging or screening.

A second tray 68 and a third tray 70 (FIGS. 1 and 4) are provided to maximize retention of valuable materials as mining sluice 10 is operated as hereinafter described. Rugging and screening is also provided on the surfaces of trays 68 and 70 and means are also provided to retain the screening and rugging in place on those trays. As shown in FIGS. 1 and 4, trays 66, 68 and 70 are arranged in zig-zag fashion relative to one another. For example, second tray 68 is positioned at an angle relative to the horizontal and with its uppermost end beneath the lowermost end of first tray 66 so that material may pass from first tray 66 onto second tray 68. Similarly, the uppermost end of third tray 70 is positioned beneath the lowermost end of second tray 68 so that material may pass from first tray 66 onto second tray 68. The lowermost end of first tray 66 is pivotally connected at 78 to the uppermost end of second tray 68 and, similarly, the lowermost end of second tray 68 is pivotally connected at 80 to the uppermost end of third tray 70.

Pivotal interconnection of the trays may be effected as shown in FIG. 11A (which illustrates interconnection of trays 68 and 70). The lowermost ends of each tray are slotted as shown at 82 (in the case of tray 68) for engagement with rivets 84 which protrude from side plates 86 of the tray which is to be interconnected with the slotted tray. (In FIG. 11A tray 70 has a side plate 86 and is to be interconnected with slotted tray 68). The uppermost ends of trays 66 or 68 may thus be raised or lowered while their respective lowermost ends pivot about the rivets. The slotted tray ends also facilitate withdrawal of the trays from between leg support members 12 for cleaning or disassembly of the apparatus.

In the first or second embodiments, deflector pan second end 40 is slotted as shown in FIG. 5 in similar fashion to the lowermost ends of the tray, to facilitate accurate positioning of deflector pan 36 with respect to the uppermost end of first tray 66 and to simplify withdrawal of deflector pan 36 from the apparatus if disassembly is required. Slotted deflector pan second end 40 engates the lower lip of frame 30.

The lowermost end of third tray 70 rests upon a support brace (not shown) which extends between the two vertical support members 12 astride the lowermost end of third tray 70. Similarly, the uppermost end of first tray 66 rests upon a support brace (not shown) which extends between the two vertical support members 12 astride the uppermost end of first tray 66. Wing nuts and bolts are used to removably affix the support braces between leg support members 12. The support braces may be raised or lowered to vary the angle of inclination of the trays with respect to the horizontal.

FIG. 11A also illustrates a semi-cylindrical shaped deflector 88 for guiding material from second tray 68 onto third tray 70. Similar semi-cylindrical deflectors are positioned at the juncture of first tray 66 with second tray 68 and at the juncture of deflector pan second end 40 with the uppermost end of first tray 66. In each case, the semi-cylindrical deflectors overlap adjacent tray (or deflector pan) ends and extend from one side of the tray (or deflector pan) to the other. Each semi-cylindrical deflector is riveted as at 92 onto a bracket 90 which extends between the side plates 86 of each tray. (Advantageously, bracket 90 and side plates 86 are formed integrally at the uppermost end of each tray by suitably bending and riveting the sheet metal which forms the tray ends.)

The inventor considers it important that all component parts of mining sluice 10 be square where they are bent or attached to any mating components. When assembling the apparatus, every effort should be made to ensure that all components of mining sluice 10 are aligned square relative to any mating components. Otherwise, materials may not flow evenly over the various surfaces of mining sluice 10, but may instead tend to accumulate along edges of various components leading to undesirable buildup of material which may block the even flow of material through the sluice and inhibit maximal retention of valuable materials.

In operation, mining sluice 10 is erected in one of the three embodiments shown in FIGS. 1 thru 4 at a mining site such as a flowing stream having a gravel bar in which particulate valuable material has been detected. A sloped "mud box" 94 (a portion of which is shown in FIG. 1) is positioned above the grizzly. Water is diverted from the stream and caused to flow into the mud box, thus washing material which is dumped into the mud box onto the top of the grizzly.

Relatively bulky material which cannot pass through the grizzly rolls down the grizzly sides and is deflected away from the base of mining sluice 10 by deflector fins 32 and 34. Less bulky material which passes through the grizzly is conveyed by the flowing water onto the deflector pan for even distribution over the deflector pan surface.

The flowing water carries the raw material over the sloped surface of the deflector pan towards its lowermost end. The flowing material is guided from the lowermost end of the deflector pan onto the uppermost end of first tray 66. The material is then washed over the screen and rugging on first tray 66 and is eventually guided onto second tray 68 by the semi-cylindrical deflector which overlaps adjacent ends of trays 66 and 68. Relatively heavy valuable material such as particulate gold or platinum tends to sink with respect to the flowing raw material and is trapped by the ridges of the screen and/or by the rugging on the tray surfaces. The raw material is washed across the surface of second tray 68 and thence across the surface of third tray 70. Waste material is eventually rejected from the lowermost end of third tray 70.

Mining sluice 10 may be easily adjusted at the mining site according to conditions prevailing at the site in order to maximize the retention of valuable materials. For example, if it appears that relatively fine particulate material such as gold dust may be recovered at the mining site, then first tray 66 should be positioned at a relatively large angle with respect to the horizontal and trays 68 and 70 positioned at a relatively smaller angle with respect to the horizontal so that waste material will quickly be washed through the mining sluice for rejection off the lowermost end of third tray 70, leaving the heavy valuable material trapped in the screening or rugging which covers the trays. If relatively heavier materials such as gold nuggets appear to be recoverable at the mining site, then it is desirable to position each of trays 66, 68 and 70 at a relatively large angle with respect to the horizontal to avoid washing those heavier valuable materials through the mining sluice and onto the waste pile.

In any case, the angle of inclination of each of trays 66, 68 and 70 relative to the horizontal may be adjusted simply by raising or lowering the braces which support the uppermost end of first tray 66 and the lowermost end of third tray 70. Adjustment of these braces will automatically result in compensating changes at pivotal connections 78 and 80 which interconnect trays 66, 68 and 70. If desired, the trays may be positioned at varying angles relative to the horizontal by, for example, moving only the brace which supports the uppermost end of first tray 66, or, alternatively, moving only the brace which supports the lowermost end of third tray 70. The adjustment selected will depend upon the volume of water which passes through the apparatus, the conditions at the mining site insofar as the prevalence and type of valuable material is concerned and the skill of the individual miner.

The first embodiment illustrated in FIGS. 1 and 2 may serve as a relatively compact "testing" unit for determining whether a given site may bear worthwhile deposits of particulate valuable material. The "testing" unit may be provided with relatively short trays (each approximately 18 inches long). The second or third embodiment may serve as a full scale mining sluice for use at a proven mining site. To convert the testing unit to the full scale mining sluice of the second or third embodiment, the testing trays are removed and cross braces 14 are adjusted accordingly by affixing their ends between different pairs of holes in vertical leg supports 12 so as to move leg supports 12 further apart to accommodate the longer trays used in the full scale mining sluice. Those of base supports 16 which lie parallel to the sides of the trays are removed and replaced with longer base support members. Support bracket 96 (FIG. 3) braces panel 26 against leg supports 12 to prevent movement of grizzly 18 during operation of the second embodiment. In this manner the "testing unit" of the first embodiment may be converted to the full scale mining sluice of the second or third embodiment to accept sluice trays of about 3 to 6 feet in length.

It will be readily apparent to those skilled in the art that if wing nuts and bolts are provided for fastening support members 12, braces 14 and 16, and the support braces which support the uppermost end of first tray 66 and the lowermost end of third tray 70, then mining sluice 10 may quickly be assembled or disassembled at the mining site. As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A mining sluice, comprising:

(a) an inverted generally V-shaped screen having first and second sides which slope downwardly and outwardly from a longitudinal axis of said screen;

(b) first and second panels for positioning at opposed ends of said screen axis to close said screen ends;

(c) a deflector pan having opposed first and second ends, said pan for positioning beneath said screen to extend between said first and second screen sides and between said first and second screen ends with said first end of said pan in contact with said first panel; and (d) a first tray for positioning beneath said deflector pan and screen at an angle relative to the horizontal and with the uppermost end of said first tray beneath said second end of said pan whereby material passing through said screen may pass over said deflector second pan end onto said uppermost tray end.

2. A mining sluice as defined in claim 1, wherein said deflector pan slopes downwardly from said first deflector pan end to said second deflector pan end.

3. A mining sluice as defined in claim 2, wherein said deflector pan further comprises first and second generally vertical sidewalls for extending between said first and second deflector pan ends to contact said first and second screen sides respectively.

4. A mining sluice as defined in claim 3, wherein said deflector pan, said sidewalls and said first panel form an integral unit.

5. A mining sluice as defined in claim 1, 2, 3 or 4 wherein said panels are sized to overlap said first and second screen ends.

6. A mining sluice as defined in claim 1, 2, 3 or 4 further comprising first and second deflector fins for positioning at the lowermost ends of said first and second screen sides to extend downwardly therefrom, whereby material placed upon said screen which does not pass through said screen may be deflected away from said mining sluice.

7. A mining sluice as defined in claim 1, 2, 3 or 4 further comprising a first semi-cylindrical trough for overlapping said second deflector pan end and said uppermost tray end to guide material from said deflector pan onto said first tray.

8. A mining sluice as defined in claim 1, 2, 3 or 4 further comprising a second tray for positioning beneath said first tray at an angle relative to the horizontal and with the uppermost end of said second tray beneath the lowermost end of said first tray, whereby material may pass from said first tray onto said second tray.

9. A mining sluice as defined in claim 8, further comprising a second semi-cylindrical trough for overlapping said lowermost end of said first tray and said uppermost end of said second tray to guide material from said first tray onto said second tray.

10. A mining sluice as defined in claim 8, wherein said lowermost end of said first tray is pivotally connected to said uppermost end of said second tray.

11. A mining sluice as defined in claim 10, further comprising support means for supporting said first and second trays, said support means including adjustable connecting means for connecting said uppermost end of said first tray to said support means.

* * * * *